US005400735A

United States Patent [19]

Yamin et al.

[11] Patent Number: 5,400,735

[45] Date of Patent: Mar. 28, 1995

[54] MODULAR CAISSON FOR UNDERWATER TASKS

[76] Inventors: Antonio A. C. Yamin, Pensilvania No. 26-201, Mexico D.F., 03810; José D. J. S. López, Reformá 615 Lomas, Mexico D.F., 11,000; Vicente R. P. Vázquez, Au Delfin Casa 7 Playo Norte, Ciudad Del Carmen, Mexico 024100, all of Mexico

[21] Appl. No.: 107,894

[22] Filed: Aug. 18, 1993

[30] Foreign Application Priority Data

Aug. 18, 1992 [MX] Mexico ..... 924775

[51] Int. Cl.[6] ..... B63C 11/00

[52] U.S. Cl. ..... 114/314; 405/188

[58] Field of Search ..... 114/314; 405/188, 195, 405/192; 166/356

[56] References Cited

U.S. PATENT DOCUMENTS

| | | | |
|---|---|---|---|
| 3,353,364 | 11/1967 | Blanding et al. | 166/356 |
| 3,495,562 | 2/1970 | Fahlman et al. | 114/314 |
| 4,913,590 | 4/1990 | Svenning et al. | 166/356 |
| 5,324,140 | 6/1994 | Lopez et al. | 405/188 |

*Primary Examiner*—Jesus D. Sotelo

*Attorney, Agent, or Firm*—Leydig, Voit & Mayer

[57] ABSTRACT

A modular caisson for use in performing underwater tasks in a dry environment includes a plurality of interconnected modules. The end of at least one of the modules is equipped with an end cover through which piping or other equipment can be passed into the caisson without leakage of water into the caisson. In a preferred embodiment, the end cover includes flexible doors. The caisson can be supported by a transport vehicle, or it can be anchored to piles by means of guides formed on the outside of the modules. As a result, the caisson can be prevented from exerting undesirable loads on the piping or other structure being worked upon inside the caisson.

33 Claims, 12 Drawing Sheets

MODULAR CAISSON FOR UNDERWATER TASKS

BACKGROUND OF THE INVENTION

This invention relates to a caisson for performing underwater operations, and more particularly to a modular caisson which can be easily varied in size or shape in accordance with operating requirements.

The need to perform assembly and/or maintenance of structures, equipment, or pipes submerged in water has led to the development of equipment making it possible to perform these operations in the most efficient and safest way possible.

At present, there are several types of equipment for use in performing underwater tasks in a dry atmosphere. However, conventional equipment for this purpose has a large number of disadvantages, such as complicated designs, excessive weight in order to withstand and counteract the upward thrust which they generate, limitations with respect to their dimensions, poor or defective watertightness due to their rigid construction, and especially a lack of adaptability to different conditions because of their fixed dimensions.

SUMMARY OF THE INVENTION

Accordingly, it is an object of the present invention to provide a modular caisson for underwater tasks which is particularly suitable for use in work on structures, equipment, or piping submerged in shallow water in lacustrine or maritime areas.

It is another object of the present invention to provide a modular caisson capable of surrounding and being installed on structures, equipment, or piping being worked on without transmitting stresses to objects on which it is installed.

It is still another object of the present invention to provide a modular caisson which possesses great adaptability and maneuverability and which can be varied in its dimensions in accordance with the task to be performed.

It is a further object of the present invention to provide a modular caisson which allows access by human workers to the interior of the caisson from the surface while providing great security and comfort to the workers who go into caisson.

A modular caisson for use in performing underwater tasks according to the present invention includes a plurality of interconnected modules, each of which can be filled with gas to provide a dry work environment for human workers. An end of at least one of the modules is equipped with an end cover through which piping or other equipment can be inserted into the caisson without leakage of water into the caisson. In a preferred embodiment, each end cover includes flexible doors. The caisson can be supported by a transport vehicle, or it can be anchored to piles by means of guides formed on the outside of the modules. The transport vehicle or piles can bear both the weight of the caisson and upward thrusts produced by the buoyancy of the caisson, so the caisson can be prevented from exerting virtually any loads on the piping or other structure being worked upon inside the caisson. Alternatively, the buoyancy of the caisson can be adjusted by independent ballast elements in the modules so that loads are not transmitted to the structure being worked upon.

Because the caisson is formed from a plurality of modules, the shape and dimensions of the caisson can be freely varied in accordance with operating requirements.

Other objects and advantages of the present invention will become clear from the following detailed description considered in conjunction with the accompanying drawings.

DESCRIPTION OF THE PREFERRED EMBODIMENTS

A number of preferred embodiments of a modular caisson according to the present invention will now be described while referring to the accompanying drawings.

Figure 1:
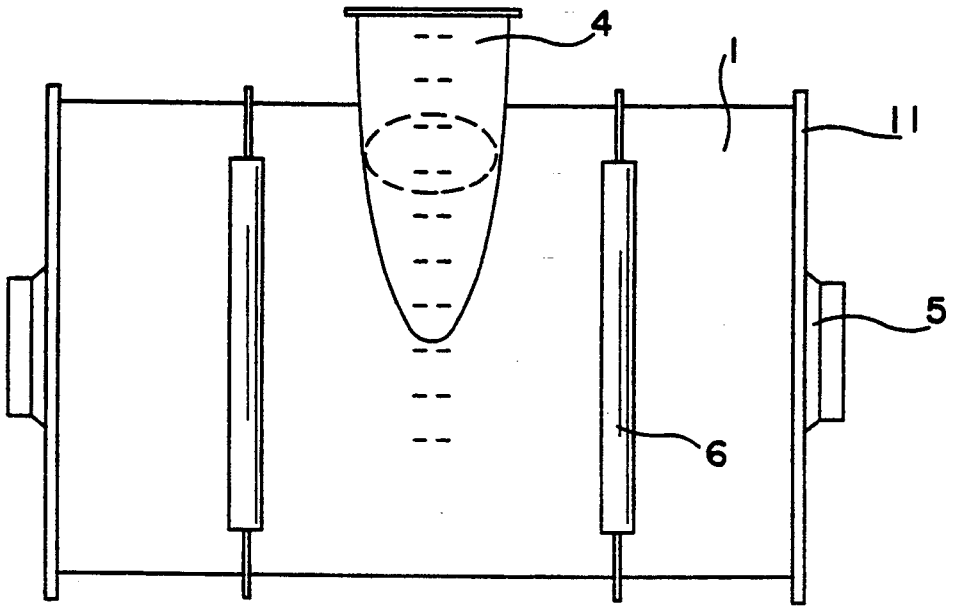
FIG. 1 is a side view of one type of module for use in the present invention having an access port and end covers forming a seal with a pipe being worked upon.
Figure 2:
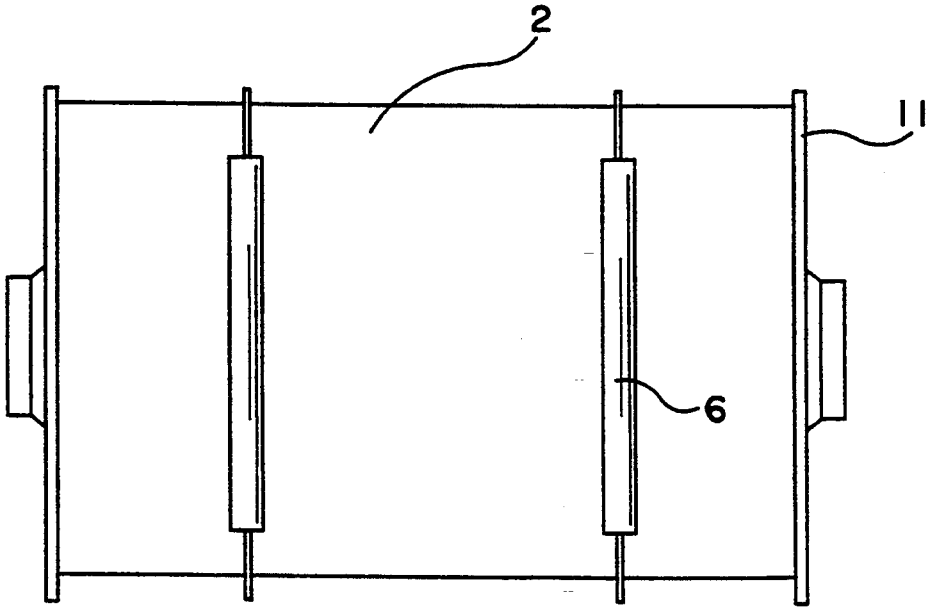
FIG. 2 is a side view of another type of module for use in the present invention.
Figure 3:
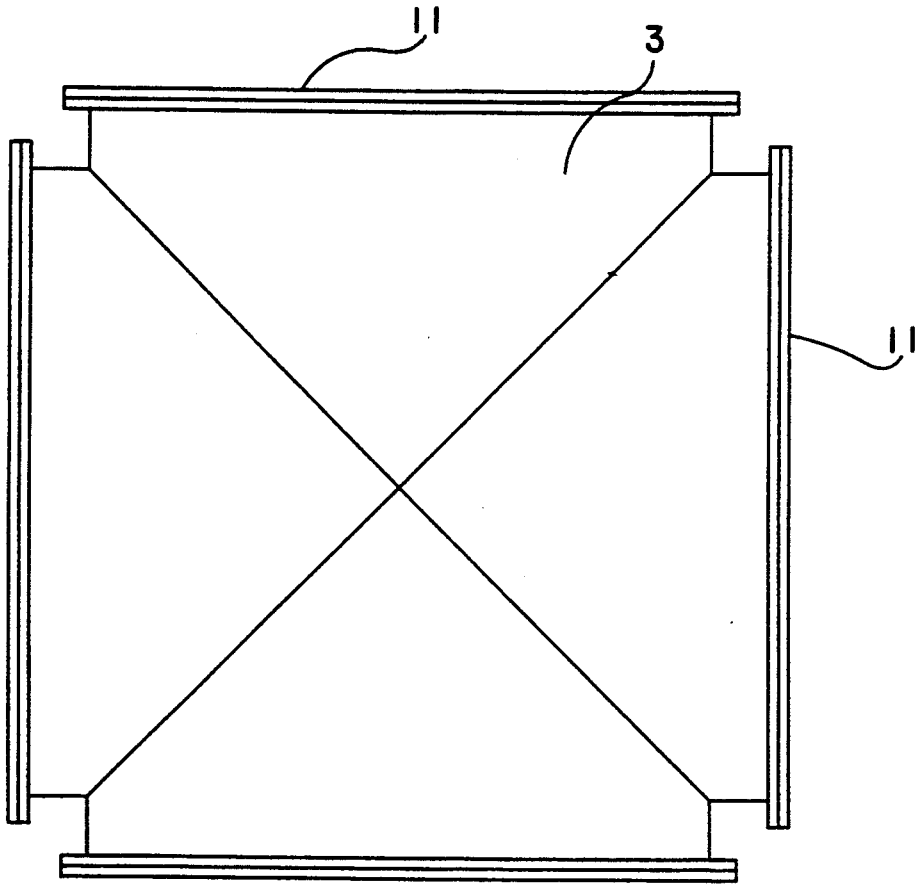
FIG. 3 is a plan view of yet another type of module for use in joining a plurality of modules at right angles.
Figure 4:
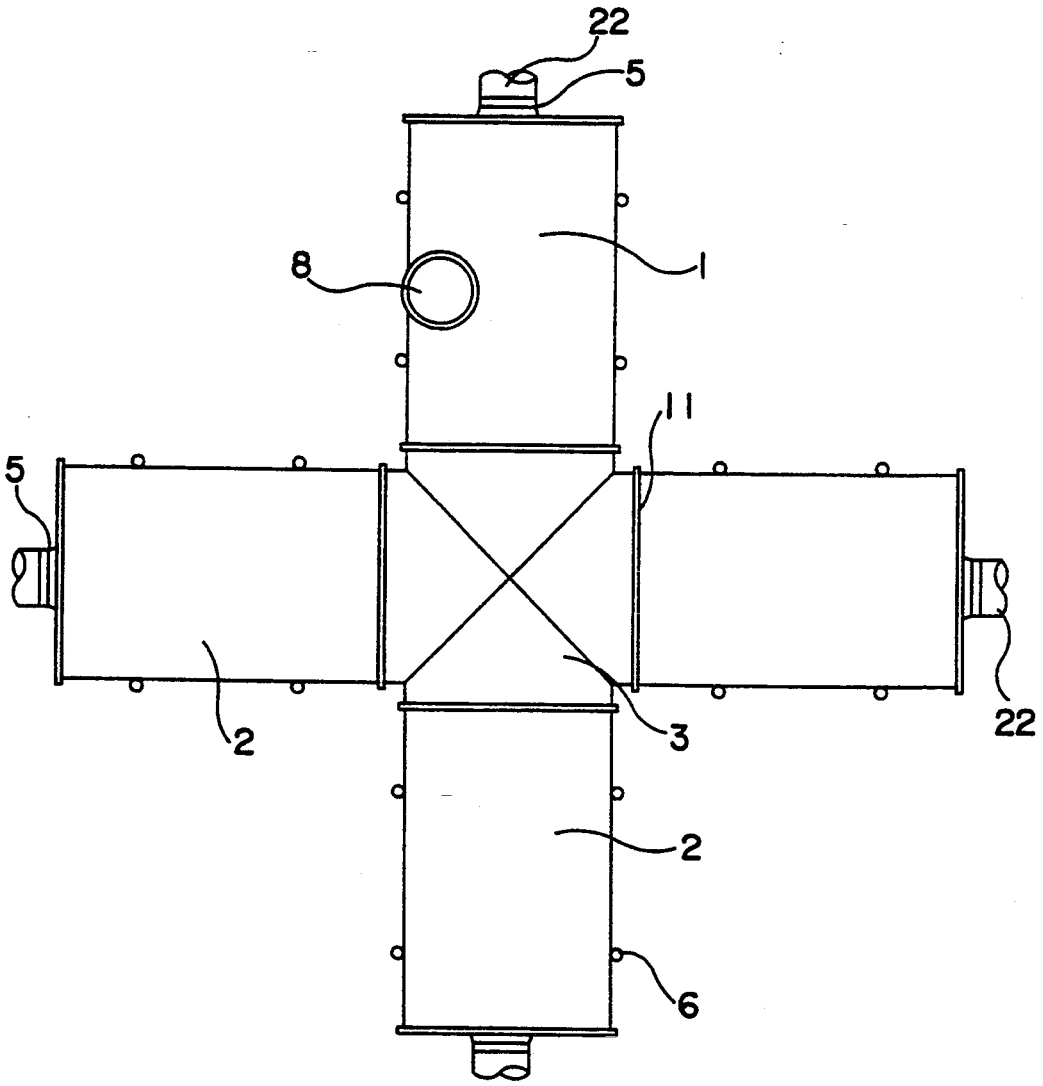
FIG. 4 is a plan view of a caisson according to the present invention comprising a plurality of modules connected along two intersecting axes.
Figure 5:
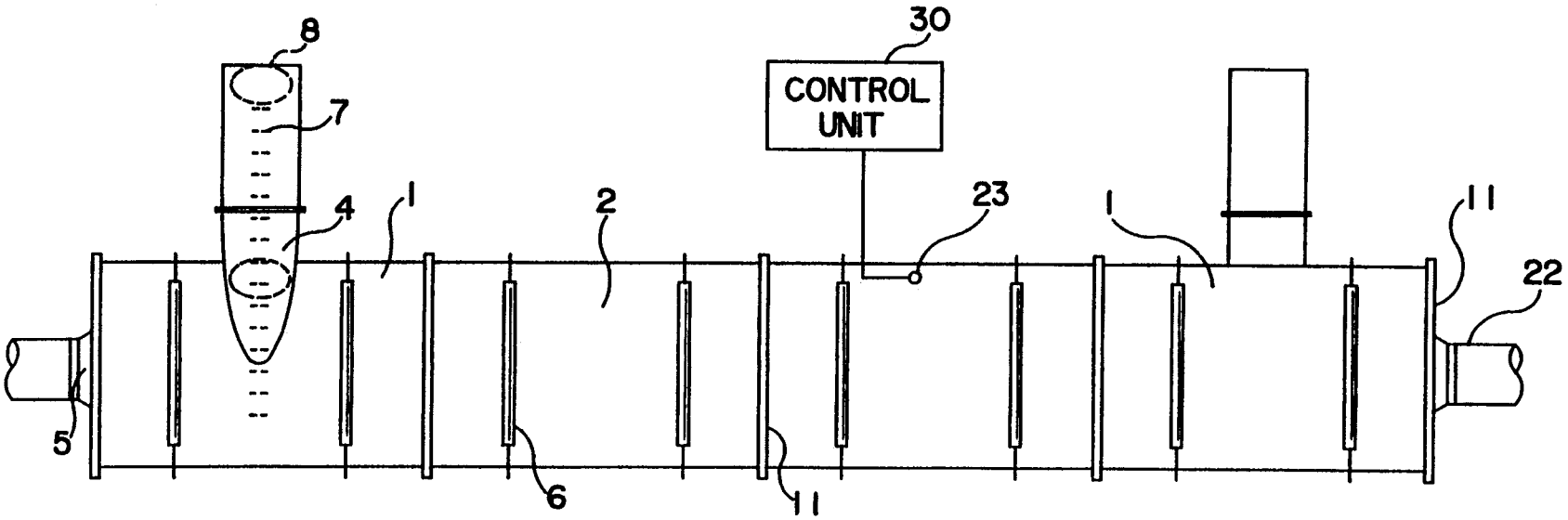
FIG. 5 is a side view of another caisson according to the present invention in which a plurality of modules have been connected together substantially coaxially.

A modular caisson according to the present invention comprises one or more modules connected together in a watertight manner. FIGS. 1 through 3 respectively illustrate a first type of module 1, a second type of module 2, and a third type of module 3 which are examples of modules which can be employed in the present invention. These modules can be combined with one another to produce a caisson having a desired shape and size, as shown in FIGS. 4 and 5, which illustrate caissons having two different arrangements of modules. The caisson shown in FIG. 4 has the shape of a cross and employs all of the three types of modules 1–3. The caisson shown in FIG. 5 is linear in shape and employs the first and second types of modules 1 and 2 connected coaxially. There is no restriction on the number of modules which can be employed to form a caisson, and a caisson according to the present invention is not limited to the shapes shown in these figures.

The first type of module 1 shown in FIG. 1 is equipped with an access port 4 which permits human access to the interior of the module 1. The second type of module 2 is used for extending the length of a caisson and is similar in structure to the first type of module 1 but is not equipped with an access port 4. The third type of module 3 is used to connect different modules to one another at an angle. It includes a plurality of openings each spaced from the adjoining opening by an angle such as approximately 90 degrees.

Each of the modules has a cylindrical body portion on the outside of which are formed guides 6 for piles that serve to anchor the caisson to the sea floor or other surface or secure the caisson to a suitable transport vehicle. The guides 6 are shown extending substantially parallel to one another in the vertical direction. An opening is formed in the lower portion of each module to permit the passage of piping or other structure, and structural joining elements 9 are provided to give the modules structural continuity.

Figure 10:
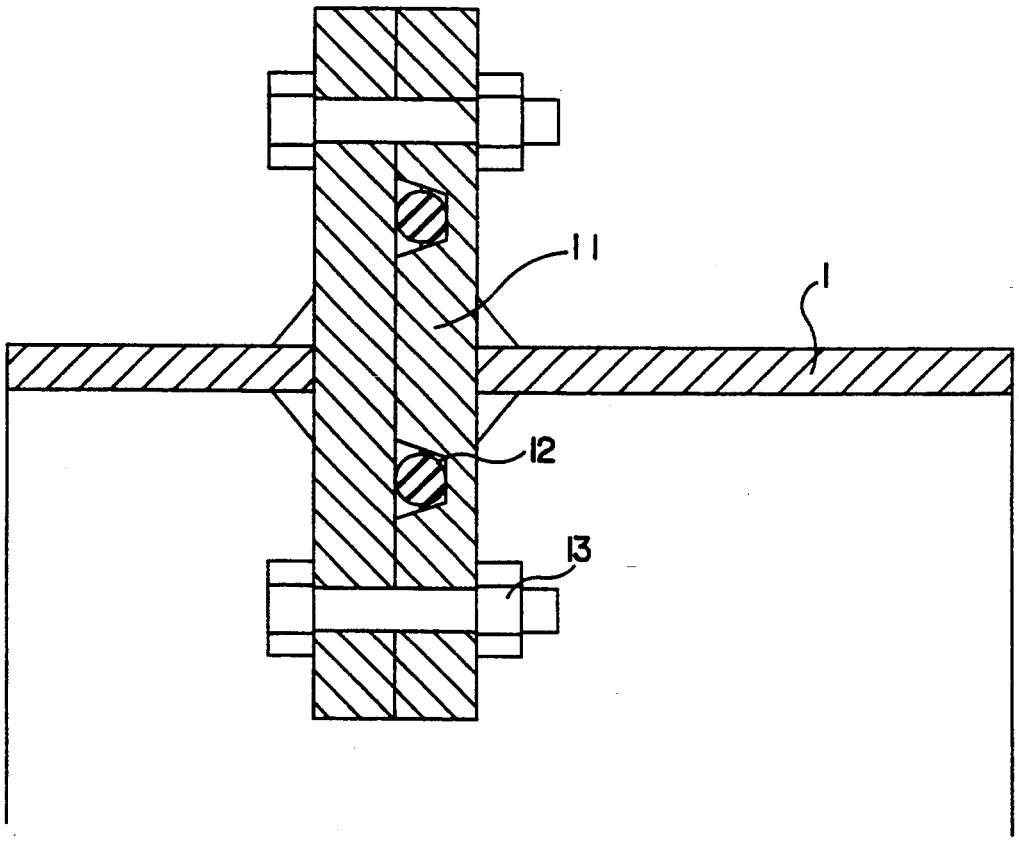
FIG. 10 is a cross-sectional view of a watertight joint between two adjoining modules.

Each module has connecting flanges 11 formed at the ends of its body portion. As shown in FIG. 10, adjoining modules can be joined to one another in a watertight fashion by abutting the flanges 11 of adjoining modules and joining the flanges 11 to one another by bolts 13 or the like. A packing 12 may be housed between abutting flanges 11 to produce a watertight joint. Preferably, the flanges 11 of each module are identical so that each module can be connected to any other of the modules. An end of a module disposed at an outer end of the caisson is equipped with an interchangeable end cover 17 attached to the module by means of one of the flanges 11. The end covers 17 include two-piece flexible doors 18 which permit piping 22 to pass through the end cover 17 into the caisson. The end of a module which is not at the outer end of a caisson can be either open or closed.

Figure 6:
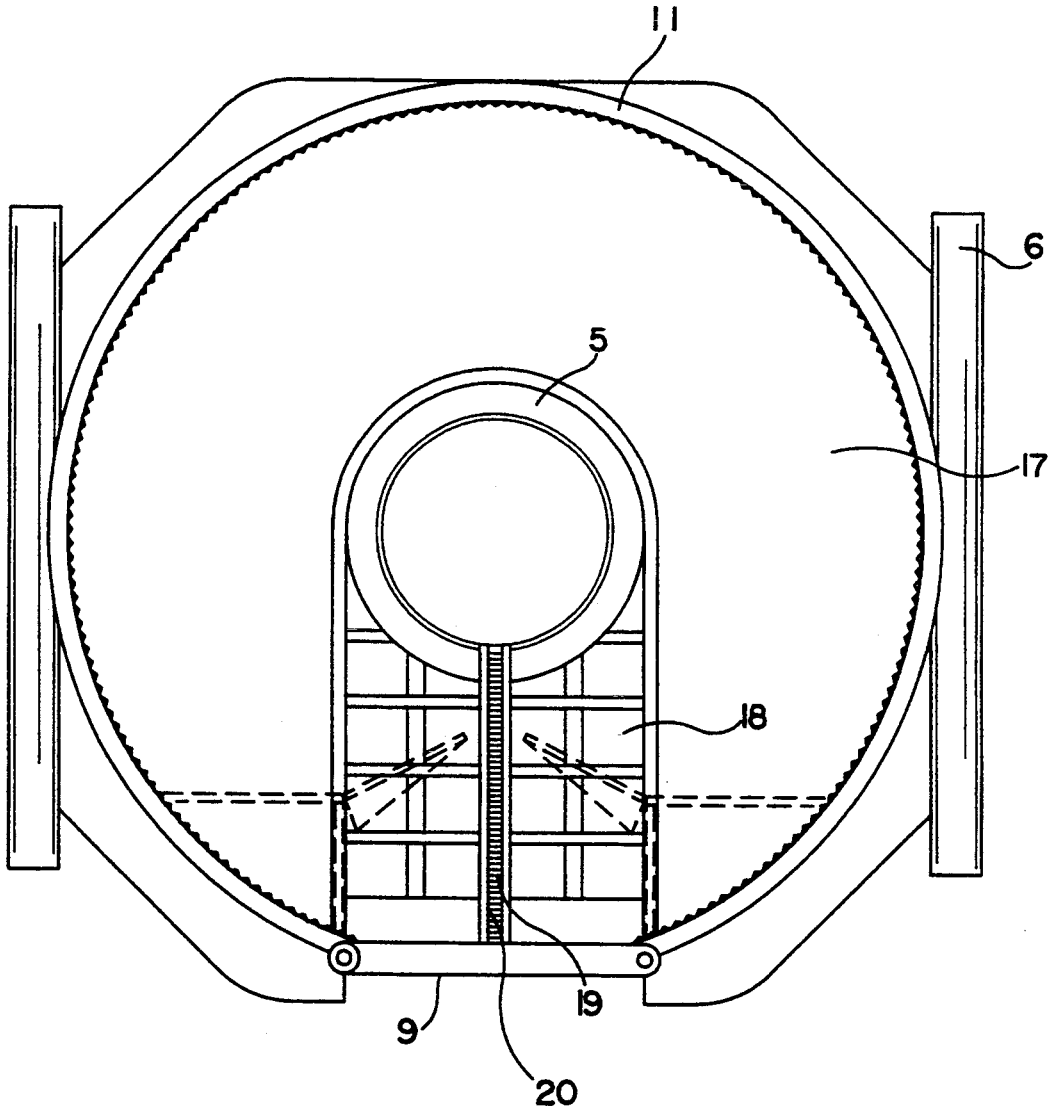
FIG. 6 is an end view of a modular caisson according to the present invention, showing an interchangeable end cover.
Figure 7:
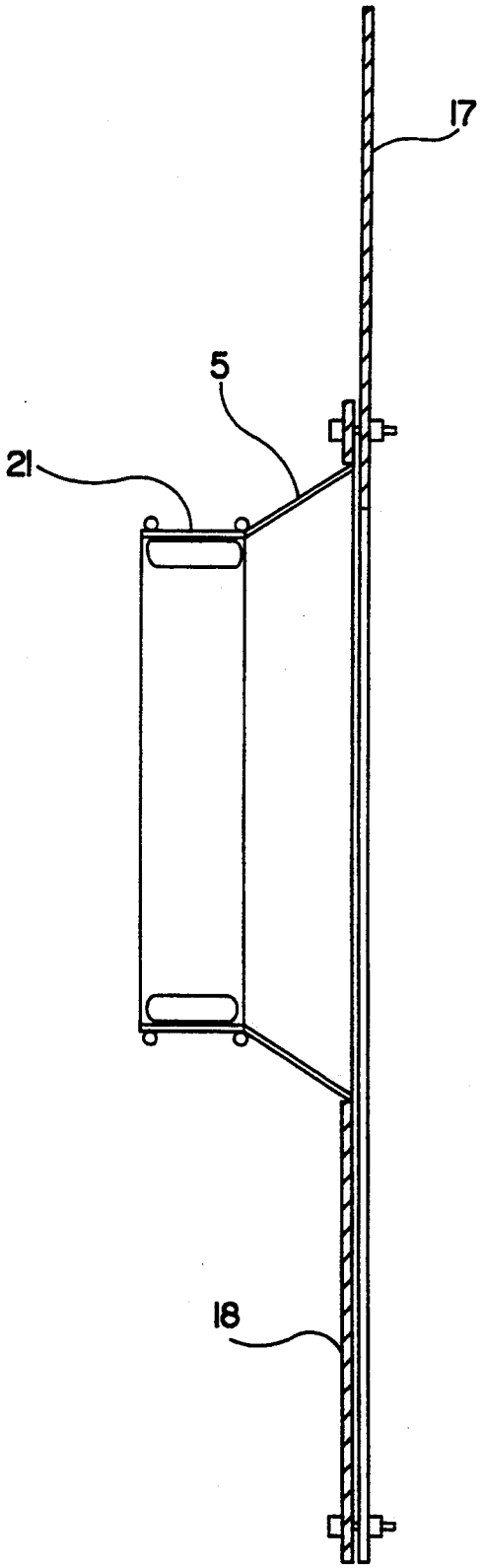
FIG. 7 is a cross-sectional view of an interchangeable end cover of a module for connecting the module to piping.

The flexible doors 18 are connected to a funnel-shaped neck 5 having a conical portion and a cylindrical portion which adjoins the conical portion and supports a seal 21 for forming a watertight joint with piping 22. As shown in FIG. 6, the end covers 17 include a watertight toothed-rack type closing system 19 for closing the doors 18 and overlapping this a structural closure 20 so that after piping 22 has passed through the doors 18, they can be closed to form a single unit.

Figure 8:
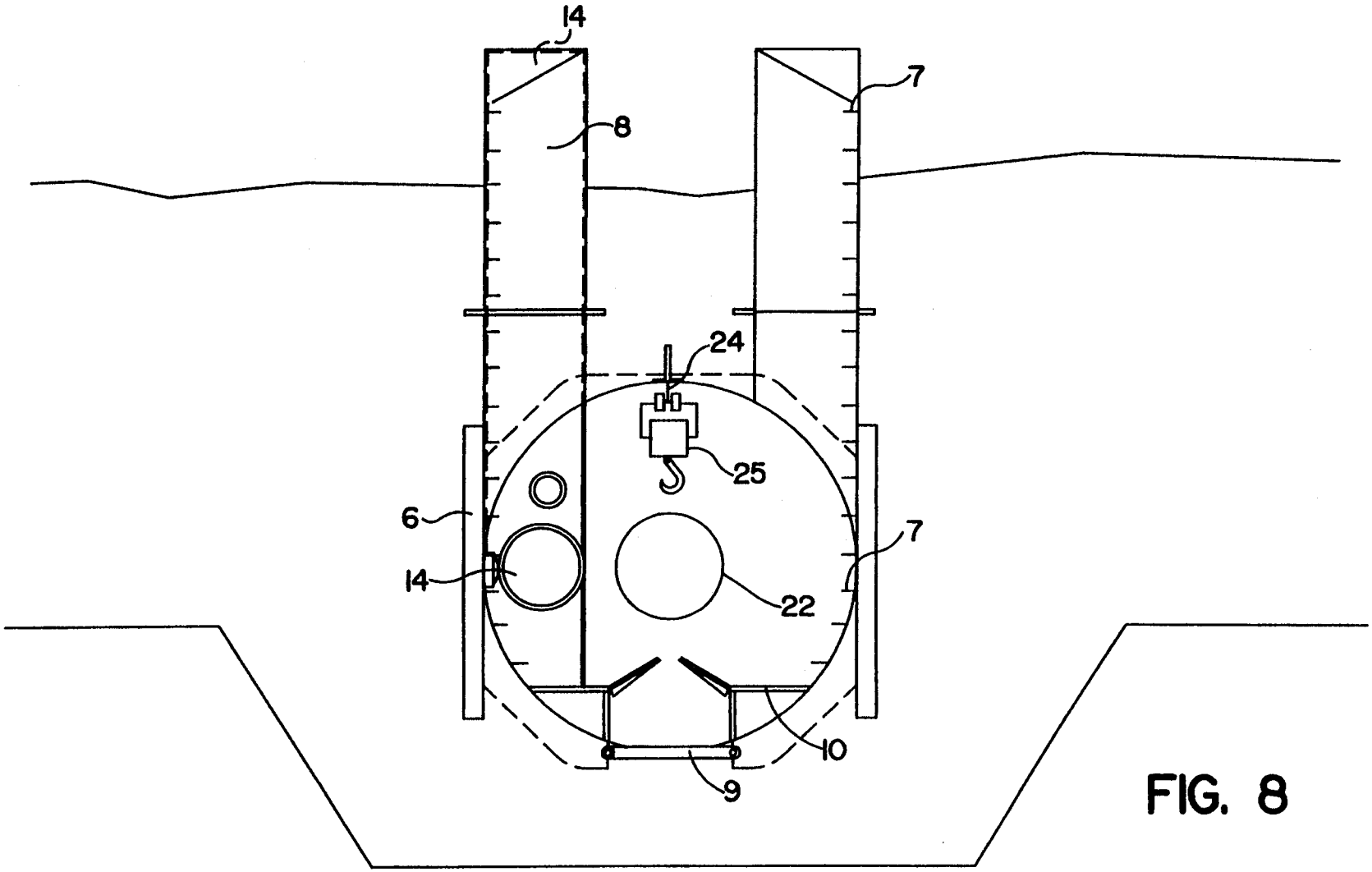
FIG. 8 is a cross-sectional view of a caisson according to the present invention.
Figure 9:
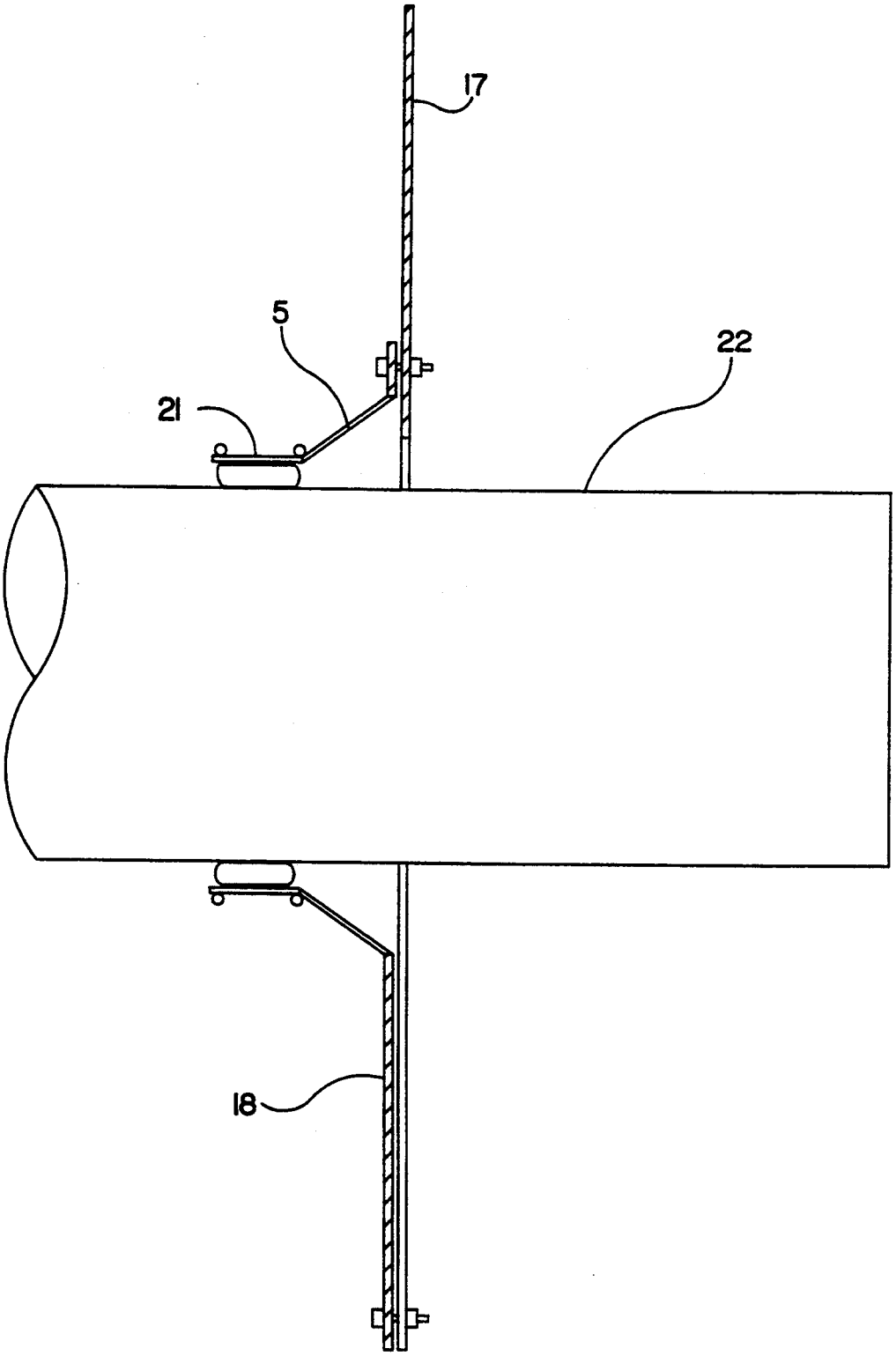
FIG. 9 is a cross-sectional view of an interchangeable end cover of a module showing how it is connected to piping.

An advantageous feature of a caisson according to the present invention is that it permits entry by a worker from the surface to the inside of the caisson through the access ports 4. The access ports 4 may include extension elements 8 connected to the main body of the access ports 4 by means of flanges 11 to vary the length of the access ports 4 in accordance with the depth at which the modular caisson is installed. When the water depth is considerable, it maybe impractical for the access ports 4 to extend all the way to the surface, so a movable diving bell that can be fastened to the flange 11 of one of the access ports 4 can be used to transport workers between the surface and the caisson. As shown in FIG. 8, two watertight hatches 14 are installed in each access port 4 to provide a pressure adjustment chamber between the two hatches 14, thereby making it possible to control the pressure in the access port 4. An access ladder 7 is also installed in each access port 4.

The inside of each module can be equipped with a collapsible floor 10 which makes it possible for human operators to move freely inside the module. It can also be equipped with a rail or longitudinal beam 24 installed along its upper portion which allow the installation of a moving crane system 25 for performing operations within the caisson.

Valves or couplings 23 can be installed on any part of the body portions of the modules to permit hoses, pipes, ducts, or electrical cables from support equipment outside the caisson (such as on the surface) to be connected to the caisson, thereby providing the necessary supplies of air, gas, fluids, and hydraulic, pneumatic, or electric power for the operation of various accessory systems for the caisson, such as lighting for the inside of the caisson. The valves or couplings 23 may be structured to permit hoses and the like to pass through the wall of the caisson. Equipment within the caisson as well as the support equipment outside the caisson can be controlled by a control unit 30 disposed on the surface, for example, and connected to the caisson by a cable through a coupling 23. The control unit 30 and the equipment it controls thus comprise an environmental control system for the caisson. The control unit 30 may include a control panel and one or more circuit boards.

Figure 11:
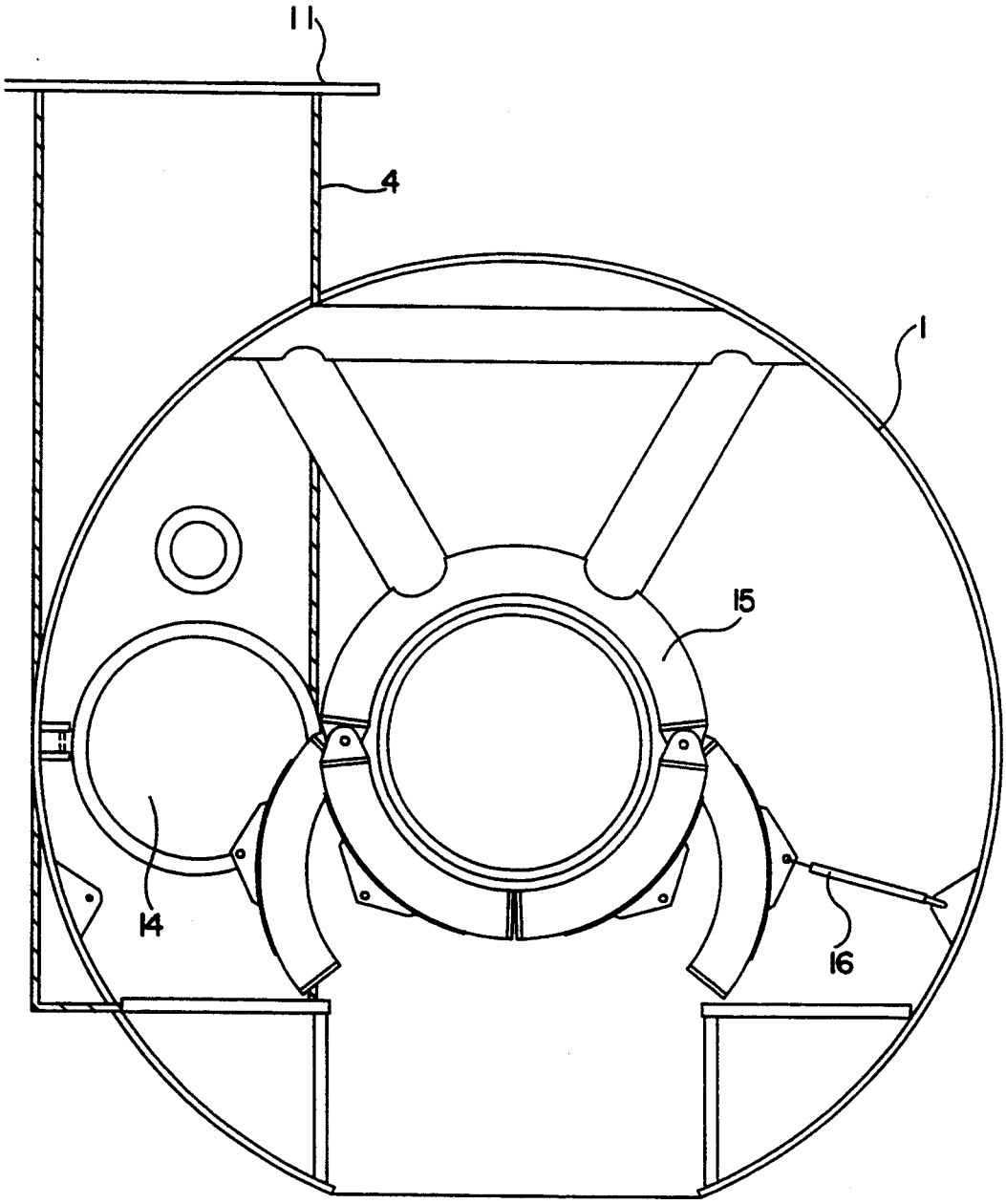
FIG. 11 is a cross-sectional view of a caisson according to the present invention, showing a hydraulically operated clamping system for piping.
Figure 12:
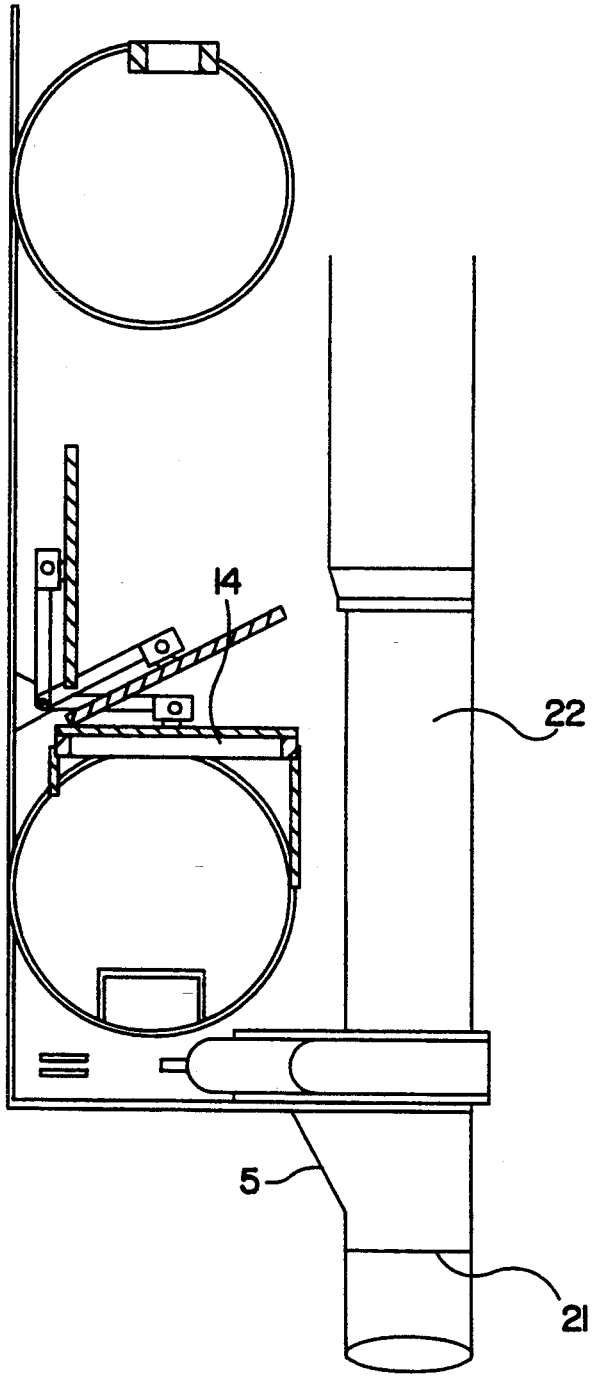
FIG. 12 is a horizontal cross-sectional view of a module showing an access hatch.

After piping 22 or other structure which is being worked upon has been inserted into the caisson through one of the necks 5, the piping 22 can be temporarily secured to the caisson by means of a clamping system, such as that shown in FIG. 11, disposed inside the caisson. The clamping system includes a multi-piece clamping ring 15 having a stationary portion which is rigidly secured to the inside of one of the modules and movable portions which can be moved between a clamped position and a released position by means of hydraulic pistons 16, only one of which is shown. In the clamped position, piping 22 can be rigidly held by means of the clamping ring 15. The hydraulic piston 16 can be remotely controlled from the surface by means of the control unit 30. After the installation of the caisson in a suitable position has been completed, the hydraulic pistons 16 can be operated to cause the clamping ring 15 to release the piping 22 so that the caisson will not transfer any stress to the piping or other structure on which the caisson is installed.

After the caisson has been positioned in a suitable location, its interior is pressurized with a gaseous mixture to displace water from its inside through its lower part so that its interior is completely dry but at a pressure higher than atmospheric pressure to permit access by workers from the surface through the access ports 4. The two hatches 14 installed in the access port 4 permit the access port to function as a pressure adjustment chamber. By opening the upper hatch 14 and closing the lower hatch 14, the access port 4 can be entered at atmospheric pressure. By then closing the upper hatch 14 and opening the lower hatch 4, the pressure within the access port 4 can be raised to the working pressure within the caisson so that workers can then enter the caisson.

Figure 13:
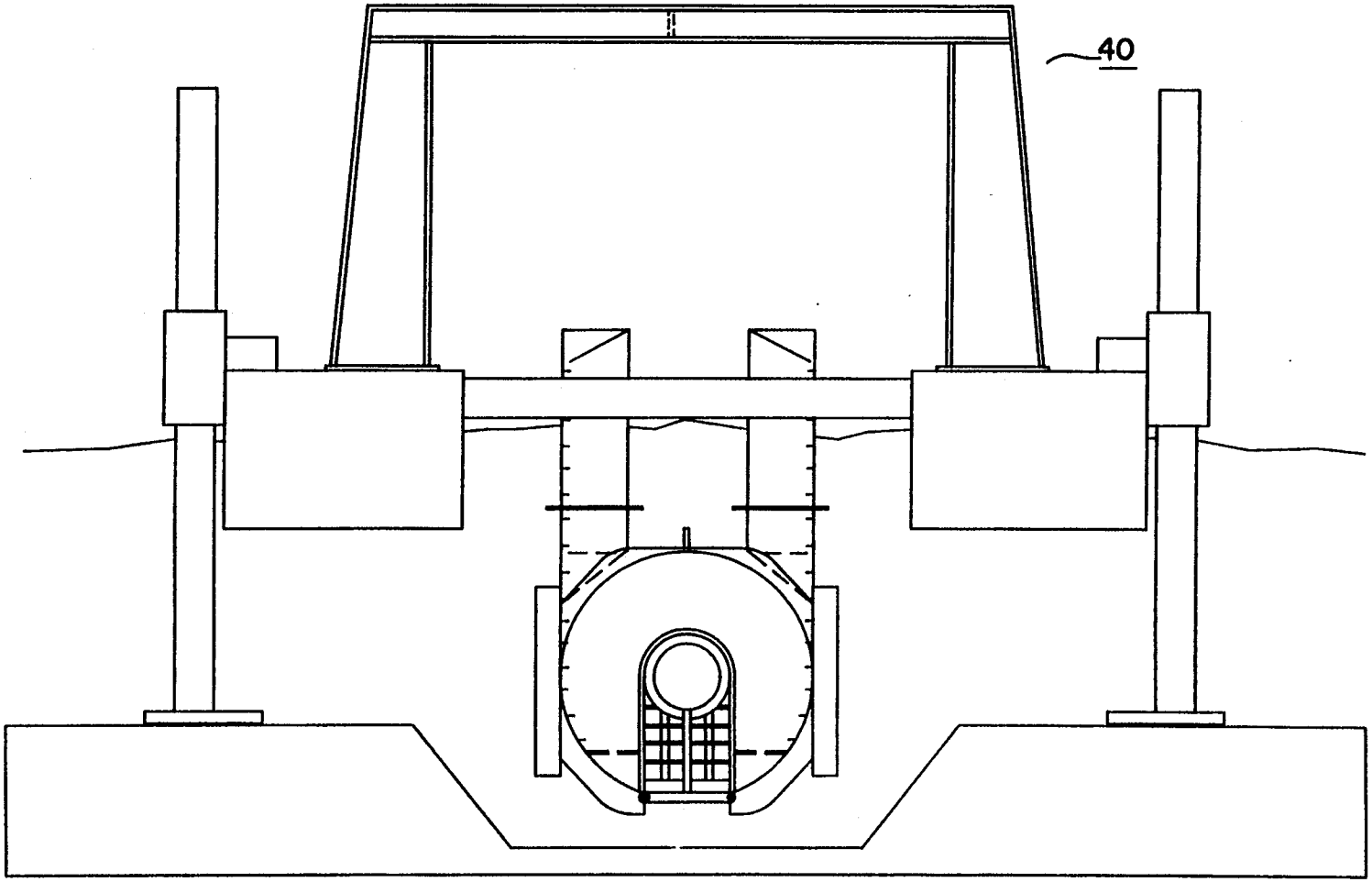
FIG. 13 is an elevation of a caisson according to the present invention supported by a transport vehicle during operation in shallow waters.

FIG. 13 is an elevation illustrating an example of operation of a caisson according to the present invention. The caisson is supported by a transport vehicle 40 which can raise and lower the caisson as well as react the upward thrusts generated by the buoyancy of the caisson. By supporting the caisson in a suitable position, the transport vehicle 40 prevents the weight or buoyancy of the caisson from applying loads to the structure being worked on, thereby preventing damage to the structure and enabling more efficient and higher quality operation.

What is claimed is:

1. A modular caisson for underwater tasks comprising:

a plurality of interconnected modules, at least one of the modules having an end and an end cover installed on the end, the end cover including an opening through which an object to be worked on inside the caisson can pass and sealing means for forming a watertight seal between the end cover and the object.

2. A modular caisson according to claim 1 wherein the end cover comprises a pair of flexible doors and means for joining the doors in a fluid tight manner.

3. A modular caisson according to claim 2 including a neck having a conical portion connected to the flexible doors and a cylindrical portion connected to the conical portion for receiving the object to be worked on.

4. A modular caisson according to claim 3 wherein the sealing means comprises a seal disposed inside the cylindrical portion.

5. A modular caisson according to claim 1 wherein the modules are detachably connected to one another.

6. A modular caisson according to claim 1 wherein the modules include a module having a cylindrical body and an access port in the body for permitting human access to the inside of the caisson.

7. A modular caisson according to claim 6 wherein the access port includes connecting means for connecting the access port to a diving bell.

8. A modular caisson according to claim 6 wherein the access port includes a pair of hatches defining a pressure adjustment chamber within the access port.

9. A modular caisson according to claim 1 wherein at least one of the modules includes a collapsible floor.

10. A modular caisson according to claim 1 including a movable crane installed along an upper portion of one of the modules.

11. A modular caisson according to claim 1 comprising pile guides installed on the outside of at least one of the modules for attaching the caisson to piles to anchor the caisson.

12. A modular caisson according to claim 1 wherein two of the modules are coaxially connected to one another.

13. A modular caisson according to claim 1 wherein at least two of the modules have nonparallel axes.

14. A modular caisson according to claim 13 wherein at least two of the modules have axes intersecting at approximately right angles.

15. A modular caisson according to claim 13 wherein one of the modules has first and second ends facing in directions approximately 90 degrees apart.

16. A modular caisson according to claim 1 including means for connecting the caisson to support equipment located outside the caisson.

17. A modular caisson according to claim 1 including independent ballast elements mounted on at least one of the modules for adjusting the buoyancy of the module.

18. A modular caisson according to claim 1 including an environmental control system for controlling an environment inside the caisson from outside the caisson.

19. A modular caisson for underwater tasks in a dry environment, adaptable to structures, equipment or piping partially or totally submerged in water, comprising a plurality of interchangeable modules that make it possible to vary the dimensions and geometry of the caisson, the modules having side covers where two-part flexible doors are located that permit the passage of an object to be worked upon inside the caisson and that subsequently are joined together by means of watertight and structural toothed racks.

20. A modular caisson according to claim 19 including environmental control systems controlled from the surface by a control panel comprising at least one board, making it possible to perform inside the caisson the underwater tasks in a dry and controlled environment.

21. A modular caisson according to claim 19 including watertight and structural closures overlapping the toothed racks at the flexible side doors.

22. A modular caisson according to claim 19 wherein one of the side covers includes a conical-cylindrical neck housing a packing and making a watertight seal between the one of the side covers and the object to be worked on.

23. A modular caisson according to claim 19 including access openings that permit access to the caisson from the surface and a set of hatches that make up a compensation chamber to control the pressure differentials between the pressure in the caisson and atmospheric pressure.

24. A modular caisson according to claim 23 wherein the access openings can be coupled to a transport diving bell from the surface.

25. A modular caisson according to claim 19 having at any part of its body at least one connector to permit connection from outside the caisson to support units of the caisson in order to thereby provide the necessary supplies for the operation of the caisson.

26. A modular caisson according to claim 19 including in its interior a collapsible floor that enables workers to move about freely.

27. A modular caisson according to claim 19 including in its upper part a travelling crane system to perform maneuvers.

28. A modular caisson according to claim 19 including guides to install piles to anchor the caisson to the bottom and thereby counteract the generated floating effects.

29. A modular caisson according to claim 19 wherein piles are used to anchor the caisson to the sea floor and thus counteract the generated floating effects.

30. A modular caisson according to claim 19 wherein independent ballast elements can be installed in the modules to counteract the generated floating effects.

31. A modular caisson according to claim 19 wherein a vehicle used to transport the caisson can be used as a means to counteract the generated floating effects.

32. A modular caisson according to claim 19 wherein the modules are fitted together by means of a watertight flange.

33. A modular caisson according to claim 19 including an interior structural ring that serves to fasten the caisson to the piping or structure during its installation.

* * * * *